US012800279B2

(12) United States Patent
Clow

(10) Patent No.: US 12,800,279 B2
(45) Date of Patent: Nov. 17, 2026

(54) AMMUNITION RELOADING KIT

(71) Applicant: RCBS Precisioneered Reloading, LLC, Shawnee, KS (US)

(72) Inventor: Marshall Dylan Clow, Magalia, CA (US)

(73) Assignee: RCBS Precisioneered Reloading, LLC, Shawnee, KS (US)

( * ) Notice: Subject to any disclaimer, the term of this patent is extended or adjusted under 35 U.S.C. 154(b) by 0 days.

(21) Appl. No.: 19/370,082

(22) Filed: Oct. 27, 2025

(65) Prior Publication Data

US 2026/0126279 A1 May 7, 2026

Related U.S. Application Data

(60) Provisional application No. 63/716,561, filed on Nov. 5, 2024.

(51) Int. Cl.
*F42B 33/02* (2006.01)

(52) U.S. Cl.
CPC ..... *F42B 33/0228* (2013.01)

(58) Field of Classification Search
CPC ..... F42B 33/0228
USPC ..... 86/31
See application file for complete search history.

(56) References Cited

U.S. PATENT DOCUMENTS 1,899,095 A 2/1933 Knight et al.
2,311,694 A * 2/1943 Rogers ..... F42B 33/0228 86/20.12
2,352,207 A * 6/1944 Knight ..... F42B 33/0228 86/31
2,395,494 A 2/1946 Mosher
2,420,668 A * 5/1947 Knight ..... F42B 33/0228 285/392
2,432,449 A 12/1947 Scoville et al.
2,791,148 A 5/1957 Maisch
3,386,329 A 6/1968 Rohrbacher
3,807,466 A 4/1974 Minneman
4,094,224 A 6/1978 Homko
4,292,877 A * 10/1981 Lee ..... F42B 33/0292 86/29
4,418,606 A * 12/1983 Lee ..... F42B 33/0292 86/44
4,890,535 A 1/1990 Bieber
(Continued)

*Primary Examiner* — Bret Hayes
(74) *Attorney, Agent, or Firm* — AVEK IP, LLC; Kent R. Erickson

(57) ABSTRACT

An apparatus for dispensing powdered material includes a funnel and an interchangeable adapter. The funnel has an inlet, an outlet, and a threaded coupling disposed below the outlet. The annular adapter includes a complimentary threaded coupling configured to selectively engage with the threaded coupling disposed on the funnel, and the adapter has an internal passage therethrough. The passage includes an inlet and a first tapered section extending downwardly from the inlet, with the first tapered section having a first draft angle. The passage includes a second tapered section extending downwardly from the first tapered section, with the second tapered section having a second draft angle. The inlet of the internal passage has a diameter greater than a diameter of the outlet of the funnel, and the first draft angle is greater than the second draft angle.

20 Claims, 8 Drawing Sheets

(56) References Cited

U.S. PATENT DOCUMENTS

2005/0183568 A1* 8/2005 Schmitt ..... F42B 33/0228
86/24

* cited by examiner

AMMUNITION RELOADING KIT

CROSS-REFERENCE TO RELATED APPLICATIONS

This application claims the benefit of U.S. Provisional Patent Application Ser. No. 63/716,561, entitled AMMUNITION RELOADING KIT, filed Nov. 5, 2025, the disclosure of which is incorporated herein in its entirety by reference.

BACKGROUND OF THE INVENTION

Field of the Invention

The present invention relates generally to the field of ammunition reloading kits. More specifically, the present invention relates to an ammunition reloading kit having a funnel and interchangeable adapters.

Background of the Invention

Used ammunition cartridges may often be reused by filling the spent shell cases or cartridges with fresh powder. Often, this may be done manually by placing a funnel over an open end of the cartridge and pouring a measured or predetermined amount of powder through the funnel into the cartridge. There may be an adapter placed between the funnel and the cartridge which allows the funnel to fit a wider variety of cartridge sizes. Depending on various factors, including but not limited to the size of the cartridge, the geometry of the funnel and/or the adapter, and the type of powder used, the funnel and/or the adapter may become clogged. Clogging of the funnel is also known as bridging. Bridging not only requires a user to clear the backup, resulting in a slower-than-desired reloading process, but also may waste material if the powder falls into crevices or other areas of the reloading assembly instead of into the cartridge itself. The present invention aims to significantly reduce the risk of bridging during the reloading process, thereby decreasing both waste and reloading time for each cartridge.

SUMMARY OF THE INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

According to an embodiment, an apparatus for dispensing powdered material includes a funnel and a plurality of interchangeable adapters. The funnel has an inlet, an outlet, and a threaded coupling disposed below the outlet. The adapters are annular and each includes a complimentary threaded coupling configured to selectively engage with the threaded coupling disposed on the funnel, and the adapter has an internal passage therethrough. The passage includes an inlet and a first tapered section extending downwardly from the inlet, with the first tapered section having a first draft angle. The passage includes a second tapered section extending downwardly from the first tapered section, with the second tapered section having a second draft angle. The inlet of the internal passage has a diameter greater than a diameter of the outlet of the funnel, and the first draft angle is greater than the second draft angle.

According to another embodiment, an apparatus for reloading gunpowder into a shell casing includes a funnel and a plurality of interchangeable adapters. The funnel includes an inlet, an outlet, and a threaded coupling disposed below the outlet. Each of the threaded adapters includes a top portion having a complimentary threaded coupling configured to selectively engage with the threaded coupling disposed on the funnel. The adapter also includes a main body having an internal passage therethrough. The passage includes an inlet, a first tapered section extending downwardly from the inlet, the first tapered section having a first draft angle, a second tapered section extending downwardly from the first tapered section, the second tapered section having a second draft angle, a radiused transition portion disposed between the first tapered section and the second tapered section, and a cavity configured to partially enclose a shell casing. The inlet of the internal passage has a diameter greater than a diameter of the outlet of the funnel, and the first draft angle is greater than the second draft angle.

According to a further embodiment, a method of reloading a shell casing with powder requires providing a hollow shell casing configured to receive powder and providing a funnel having an inlet, an outlet, and a threaded coupling. The method includes providing at least one interchangeable adapter having a complimentary threaded coupling, an internal passage having an inlet, a first tapered section extending downwardly from the inlet, a second tapered section joined to the first tapered section by a radiused transition portion, and a recessed casing seat for holding a shell casing. The method further requires coupling one of the at least one interchangeable adapters to the funnel via the threaded coupling, such that the funnel outlet abuts the inlet of the internal passage of the coupled adapter. An inlet to the shell casing is then inserted into the casing seat such that the casing seat abuts an upper surface of the shell casing. Then, powder is added into the funnel inlet such that the powder flows through the coupled adapter into the shell casing.

According to another embodiment, a method of instructing a user to load a shell casing with powder requires providing the user with a funnel having an inlet, an outlet, and a threaded coupling. The method further requires providing the user with at least one interchangeable adapter having a complimentary threaded coupling, an internal passage having an inlet, a first tapered section extending downwardly from the inlet, a second tapered section joined to the first tapered section by a radiused transition portion, and a casing seat for holding a shell casing. The method includes instructing the user to couple one of the at least one interchangeable adapters to the funnel via the threaded coupling, such that the funnel outlet abuts the inlet of the internal passage of the coupled adapter. The method further includes instructing the user to insert a shell casing into the casing seat such that the casing seat abuts an upper surface of the shell casing, and instructing the user to pour powder into the funnel inlet such that the powder flows through the coupled adapter into the shell casing.

BRIEF DESCRIPTION OF THE DRAWINGS

Illustrative embodiments of the present disclosure are described in detail below with reference to the attached drawing figures.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Figure 1:
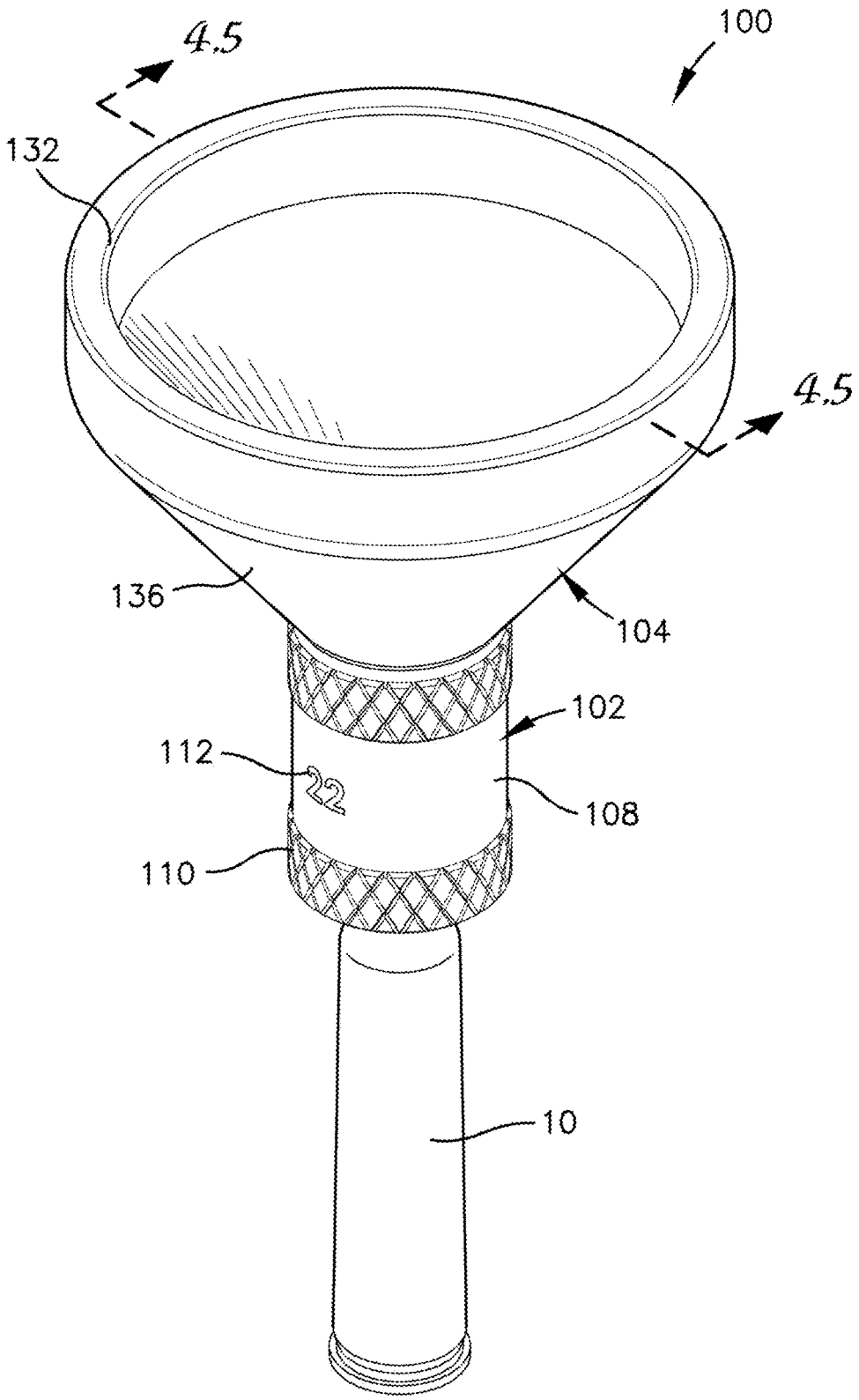
FIG. 1 is a perspective view of a reloading assembly positioned on top of an ammunition cartridge according to an embodiment of the invention.

FIG. 1 illustrates an embodiment of an ammunition reloading apparatus or assembly 100 for adding powder to a cartridge or shell casing 10. The ammunition reloading assembly 100 generally comprises two elements: an adapter 102 for fitting over the casing 10 and a funnel 104 which is threadingly connected to the adapter 102. Powder (such as extruded powder or ball powder) is added by a user to the funnel 104 and is fed into the casing 10 via the adapter 102. The user generally will measure, typically by weight, the required amount of powder before adding the powder to the funnel 104. The casing 10 may be held manually by a user during the reloading process, or may be placed in a suitable loading block and secured in the loading block while the powder is added. When all of the desired powder has passed through the reloading assembly 100 into the casing 10, the reloading assembly 100 is removed from the casing.

Figure 2:
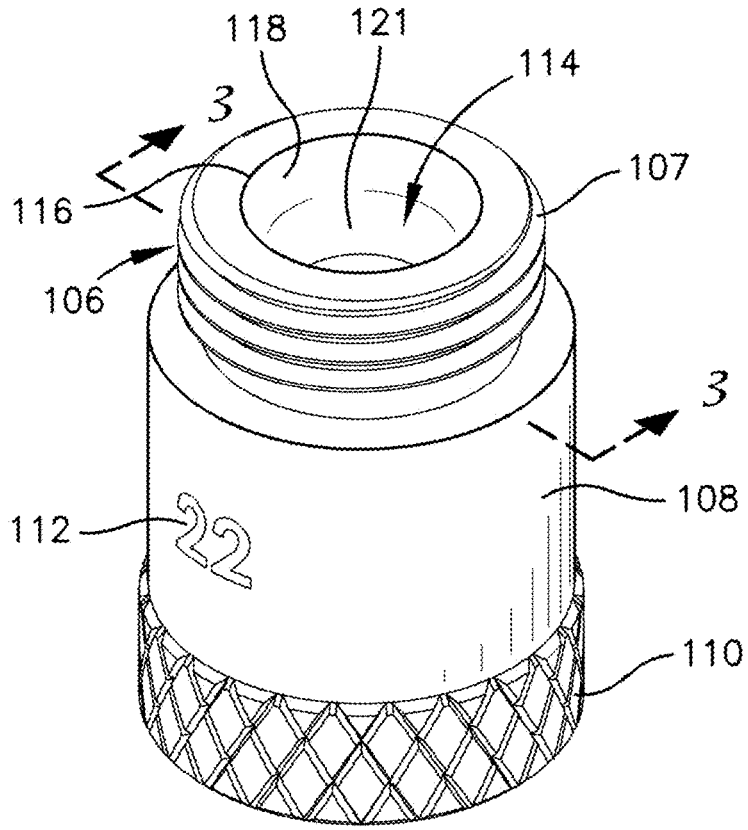
FIG. 2 is a perspective view of an adapter forming part of the reloading assembly of FIG. 1.
Figure 3:
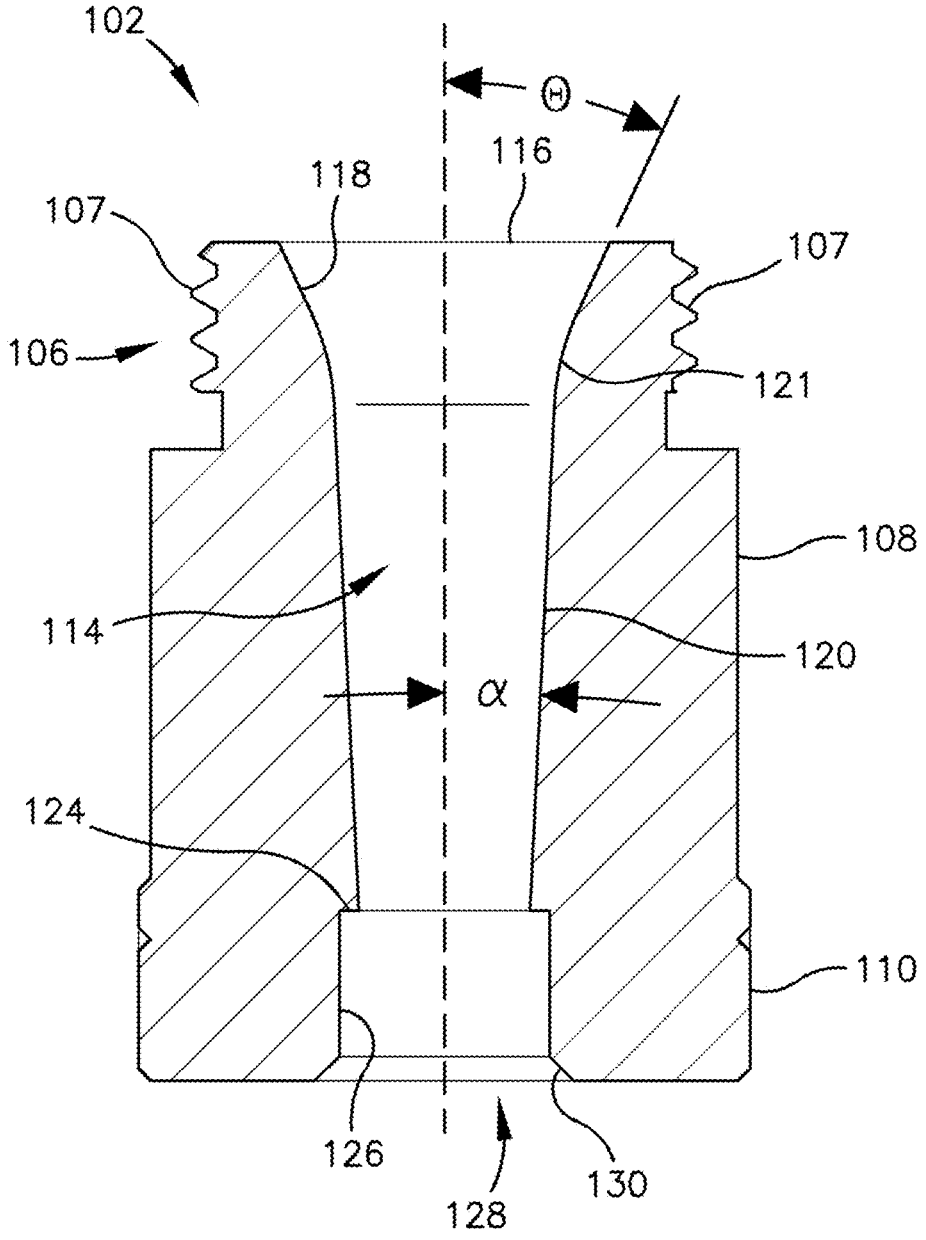
FIG. 3 is a cross-section view of the adapter of FIG. 2.
Figure 7:
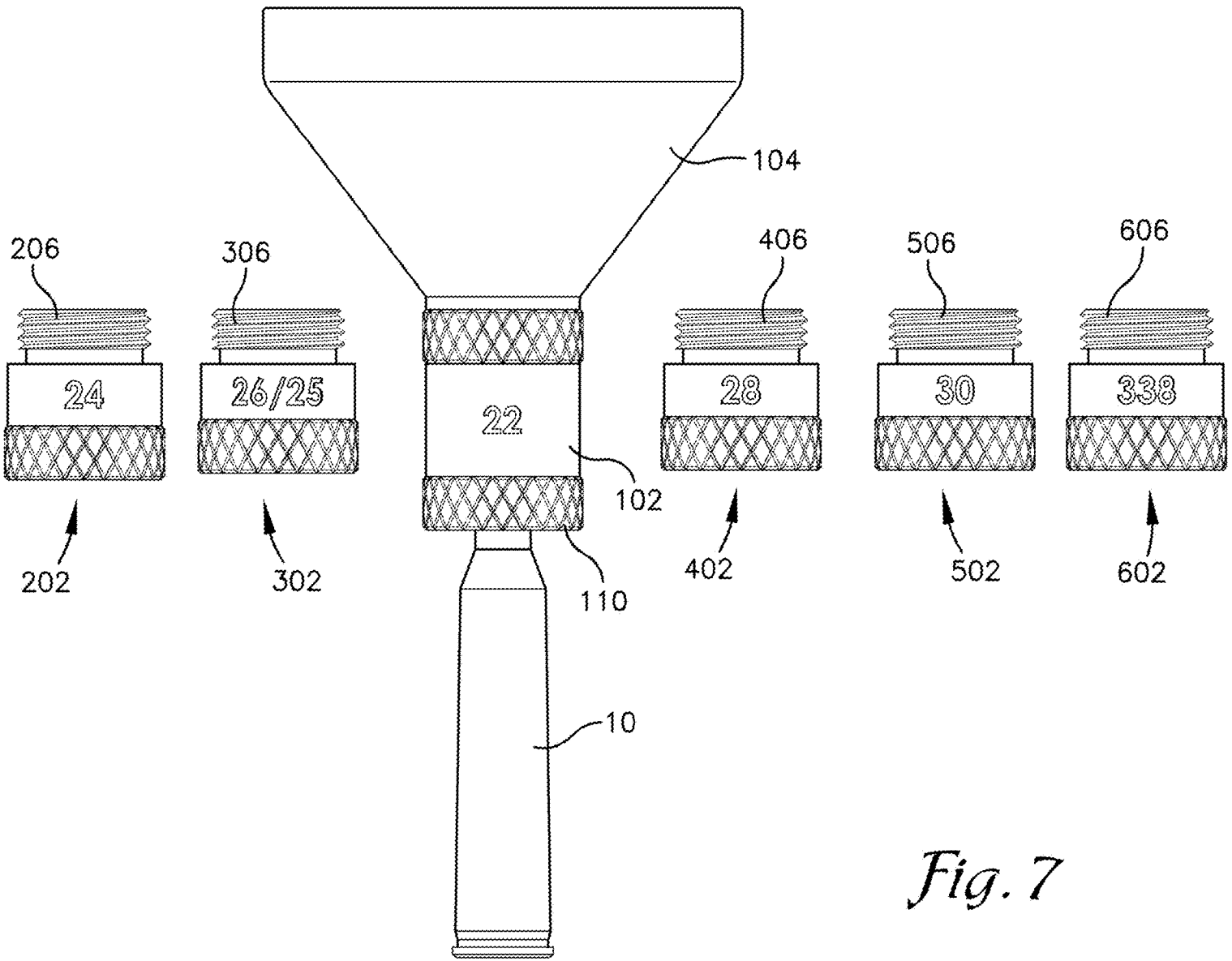
FIG. 7 is a front view of the reloading assembly of FIG. 1, including additional interchangeable adapters for various cartridge sizes.
Figure 8:
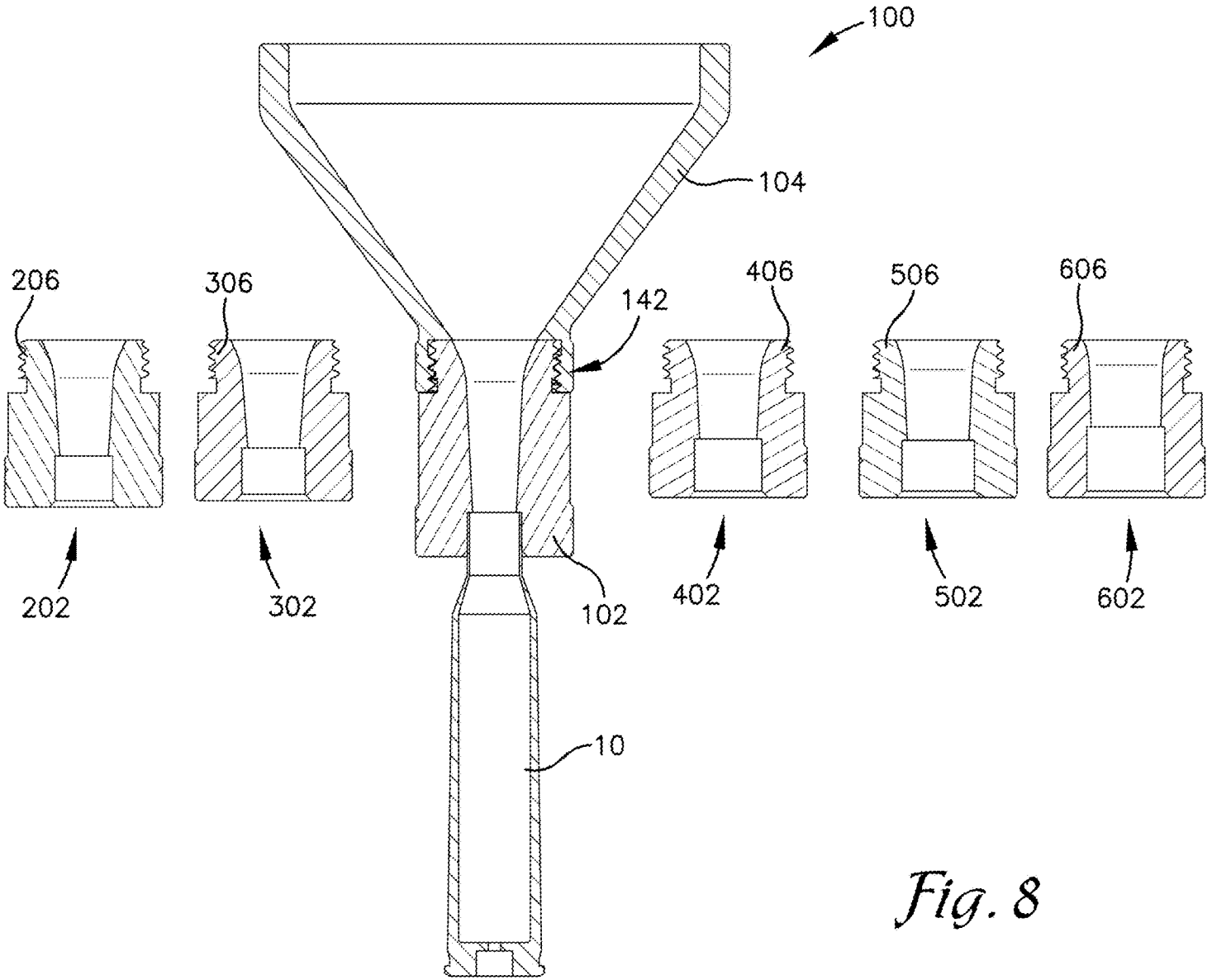
FIG. 8 is a cross-section view of the reloading assembly and interchangeable adapters of FIG. 7.

FIGS. 2 and 3 depict an embodiment of an interchangeable adapter 102 for use in the reloading assembly 100. For exemplary purposes, the adapter 102 shown in FIGS. 2 and 3 is sized for a .22 caliber round, although a skilled artisan will understand that the adapter 102 may be sized to fit any size of ammunition now known or later developed without departing from the scope of the invention. FIGS. 7 and 8 illustrate additional examples of adapters sized to fit various common casing 10 sizes. Turning specifically to FIG. 2, the adapter 102 is annular in shape, having a threaded top portion 106, a main body 108, and a lower textured portion 110. The threaded top portion 106 includes external threads 107 which are sized to threadingly couple with corresponding internal threads disposed on the funnel 104. Externally, the main body 108 is generally straight, and may include a visual indicium 112 that allows the user to easily identify the corresponding casing 10 size. This may include, as in the illustrated embodiment, an engraved number corresponding to the caliber of the round (e.g., "22" for a .22 caliber, "30" for .30 caliber, etc.) which may be etched, stamped, milled, cut, or otherwise formed on an exterior surface of the main body 108. In other embodiments, it is foreseen that the visual indicia 112 may be printed upon the main body 108, either directly or via a label which may be adhered to an exterior surface of the main body 108. The exterior of adapter 102 includes a textured portion 110, which may better allow a user to grip the adapter when threadingly coupling or decoupling the adapter 102 to the funnel 104. This textured portion 110 may be knurled and/or utilize any other suitable raised or embossed pattern now known or later developed. In some embodiments, the textured portion 110 may have a maximum diameter greater than a maximum diameter of the main body 108.

Figure 5:
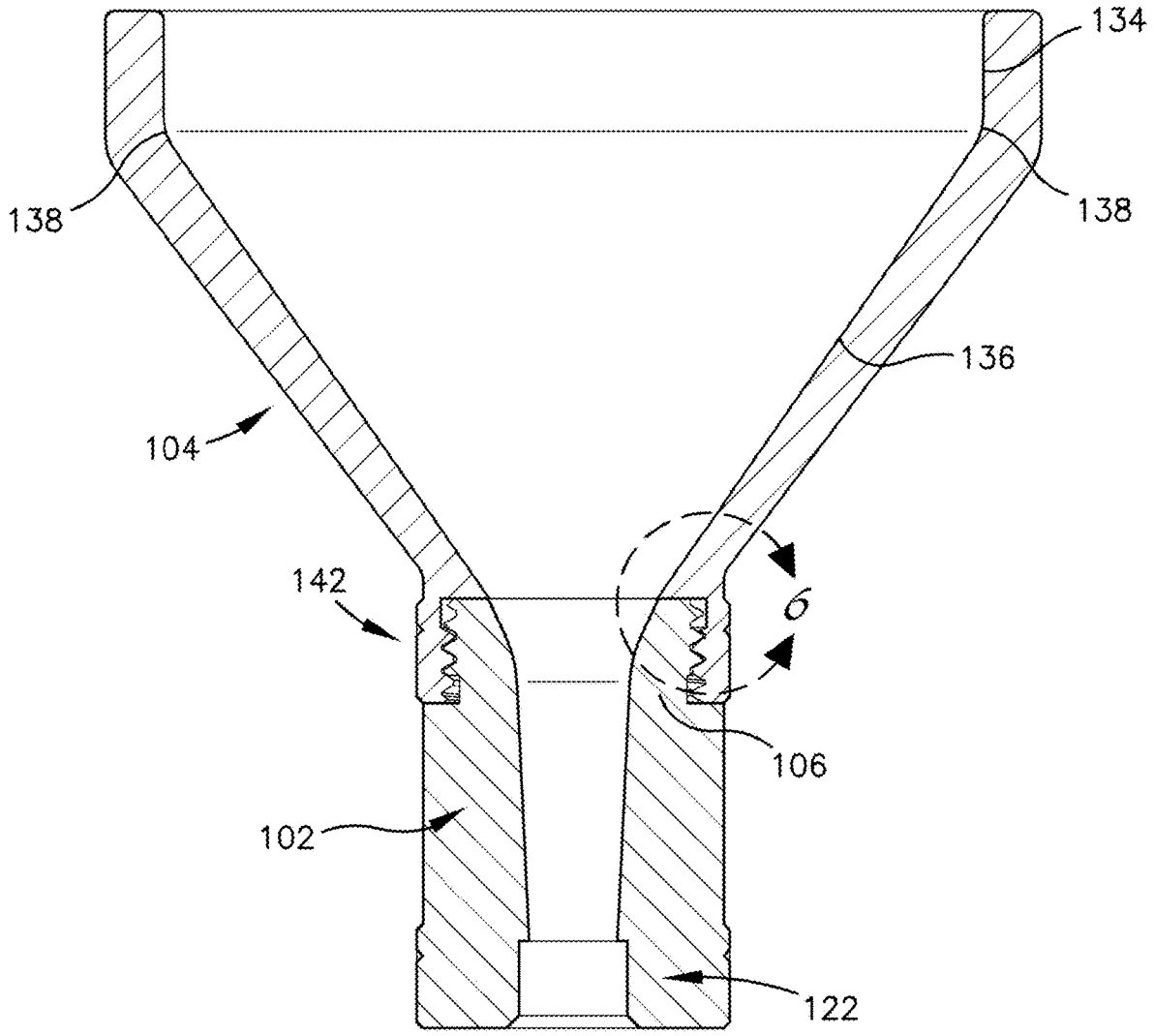
FIG. 5 is a cross-section view of the reloading assembly of FIG. 1.
Figure 6:
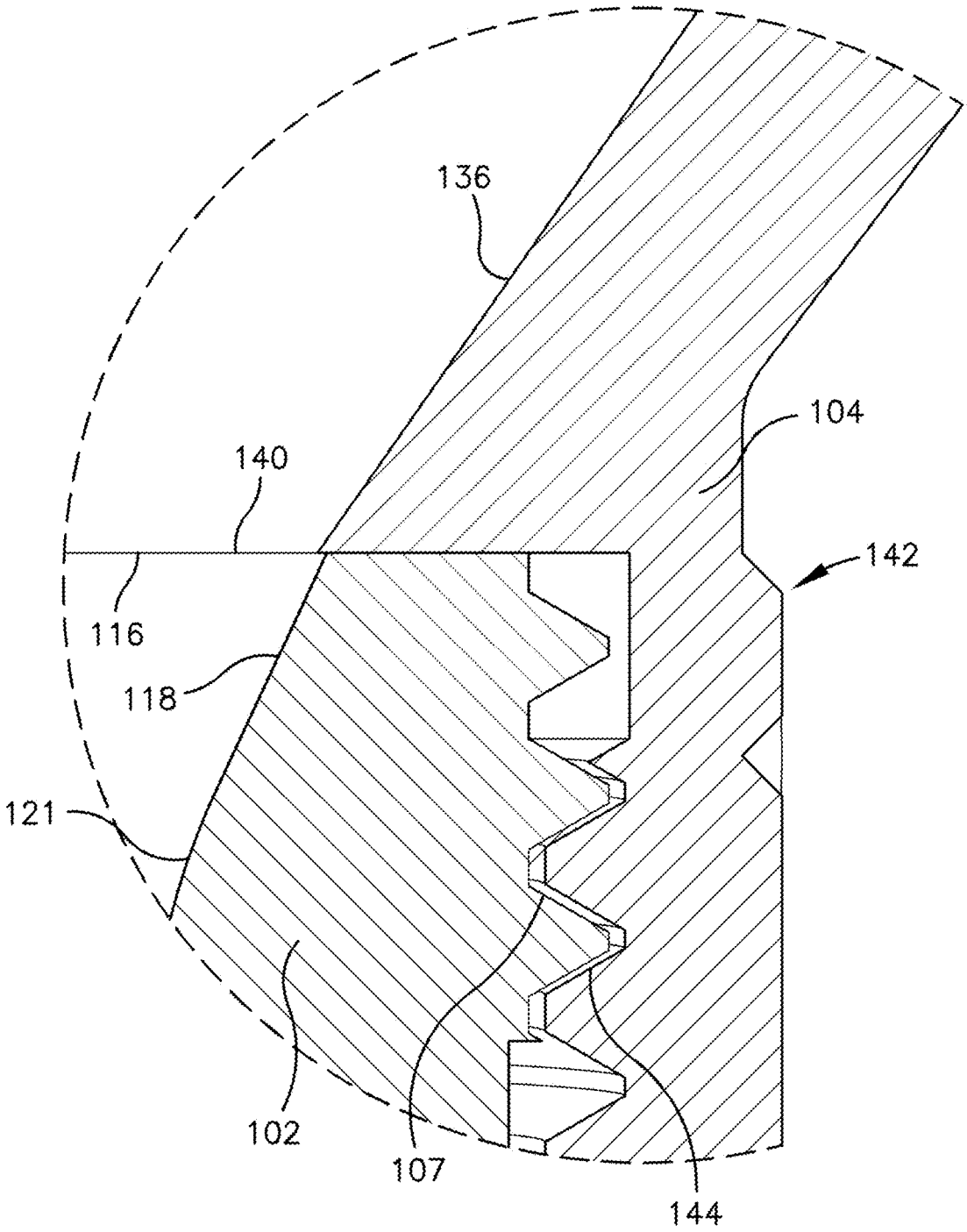
FIG. 6 is an enlarged, partial cross-section view of a threaded coupling between the funnel and adapter of the reloading assembly of FIG. 1.

Referring now to FIG. 3, a cross-section illustrating the internal geometry of the adapter 102 is shown. As stated above, the adapter 102 is annular, having an interior passageway or passage 114 through which powder may flow from the funnel 104 to the casing 10. The passage 114 has an inlet 116 located at an uppermost edge thereof, the inlet 116 being sized to receive powder therethrough from the funnel 104. As best shown in FIGS. 5 and 6, a maximum diameter of the inlet 116 is greater than or equal to a maximum diameter of an outlet of the funnel 104. The passage 114 has a first tapered section 118 which extends downward from the inlet 116. In the illustrated embodiment, the first tapered section 118 has a draft angle $\theta$ of approximately 25 degrees, although one of skill in the art will appreciate that in other embodiments the first tapered section 118 may have a draft angle $\theta$ less than or greater than 25 degrees without departing from the scope of the invention. In some embodiments, the draft angle $\theta$ of the first tapered section 118 may be less than or equal to approximately 35 degrees. In some embodiments, the draft angle $\theta$ may decrease as the size of the casing 10 increases compared to the arrangement shown in FIG. 3, which uses an approximate 25 degree angle and a .22 caliber adapter 102. As will be shown in FIG. 5, the first tapered section 118 generally has a draft angle $\theta$ less than or equal to a draft angle of the funnel 104.

The passage 114 has a second tapered section 120, which is connected to the first tapered section 118 by a radiused transition portion 121. The radiused transition portion 121 is sized such that it is tangent to both the first tapered section 118 and the second tapered section 120. This tangential relation results in a smooth, continuous surface which extends downward from the inlet 116 to the lowermost edge of the second tapered section 120, which significantly reduces the possibility of powder bridging and increases the flow rate of powder from the funnel 104 to the casing 10. The second tapered section 120 of the passage 114 utilizes a draft angle $\alpha$ that is significantly less than the draft angle $\theta$ of the first tapered section 118. In the illustrated embodiment, the draft angle $\alpha$ is approximately 2.7 degrees, although one of skill in the art will appreciate that the draft angle $\alpha$ may be greater than or less than 2.7 degrees in other embodiments not shown without departing from the scope of the invention. Preferably, the draft angle $\alpha$ is less than or equal to four degrees, as draft angles exceeding four degrees may increase the possibility of powder bridging in the second tapered section 120 of the passage 114. It is foreseen that in some embodiments, for example those sized for larger caliber shell casings, the first tapered section 118 may be omitted. Consequently, in some embodiments the radiused transition portion 121 may extend from the inlet 116 to the second tapered section 120, or in some embodiments the second tapered section 120 may extend directly from the inlet 116.

Moving downward from the inlet 116 of the passage 114, the second tapered section 120 terminates at a casing receiver or casing seat 122. The casing seat 122 is sized such that the desired casing 10 (e.g., a .22 caliber in the embodiment shown) fits within the cavity formed in the lower end of the passage 114 and is at least partially enclosed. The casing seat 122 includes and terminates at an upper end at a shoulder or substantially horizontal shelf 124 which abuts an upper surface of the casing 10 when said casing 10 is inserted into the adapter 102 for reloading, and a straight portion 126 which extends around an outer surface of the casing 10 when said casing 10 is inserted into the adapter 102 for reloading. Preferably, the shoulder 124 has a width that is equal to or preferably slightly greater than the thickness of the wall of the hollow casing 10, such that a minimum internal diameter of the lowermost end of the second tapered section 120 (and therefore the passage 114) is equal to or preferably less than a minimum internal diameter of the top of the casing 10, as illustrated in FIG. 8. Preferably an inner diameter of the straight portion 126 is equal to or slightly greater than the outer diameter of the casing 10, such that the casing 10 fits snugly into the casing seat 122, and the straight portion 126 may only have a greater diameter than the casing 10 to account for manufacturing tolerances in the casing 10 and the adapter 102. The outlet 128 of the passage 114 and the casing seat 122 may include a third tapered section or chamfer 130 to more easily allow a user to insert a casing 10 into the casing seat 122.

Figure 4:
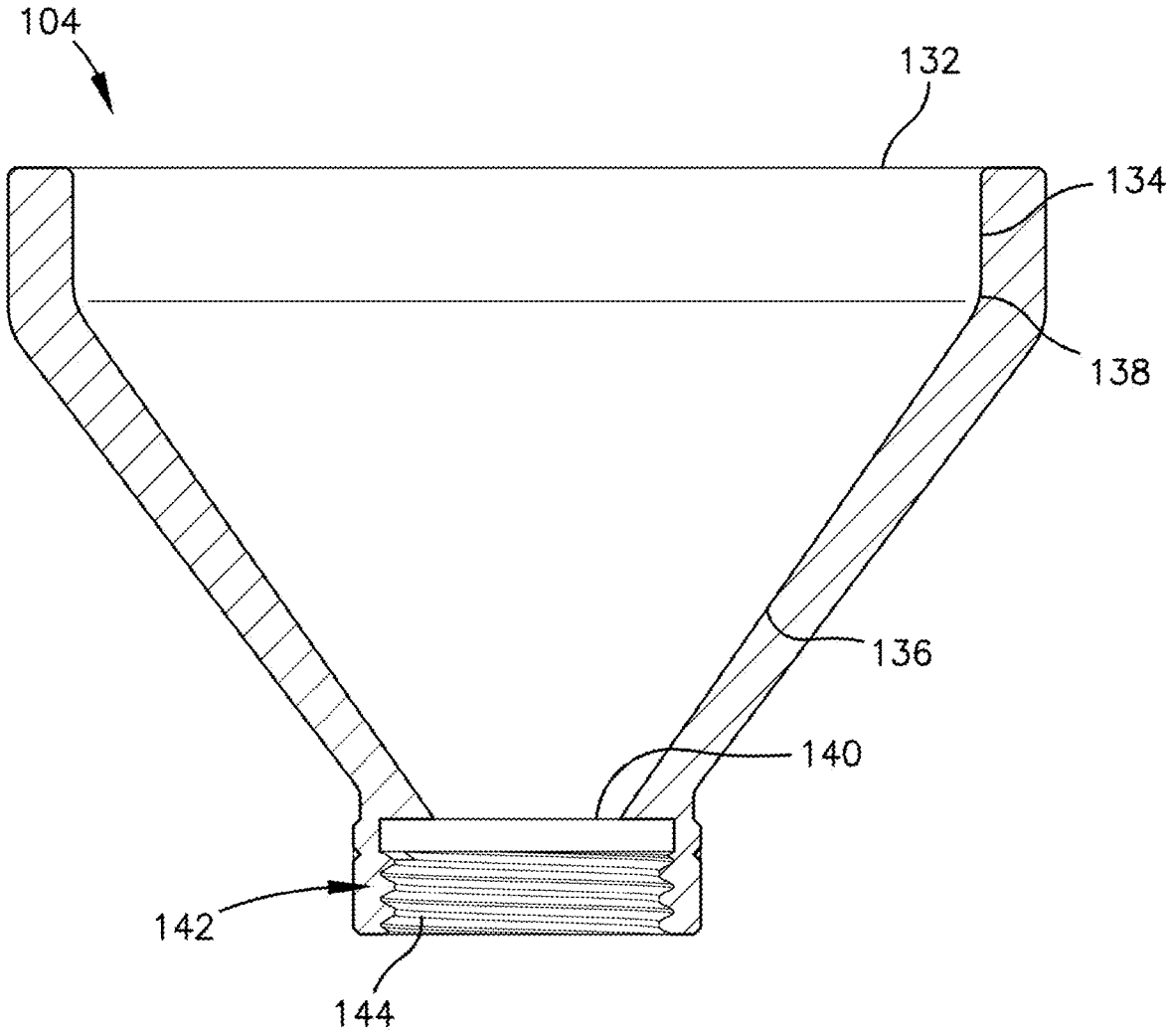
FIG. 4 is a cross-section view of a funnel forming part of the reloading assembly of FIG. 1.

Turning now to FIG. 4, a cross-section of the funnel 104 is shown. The funnel 104 has an inlet 132, a straight portion 134 extending downward from the inlet, and a conical portion 136. The conical portion 136 and the straight portion 134 are connected by a radiused transition portion 138, which is preferably tangent to both the conical portion 136 and the straight portion 134. The conical portion 136 terminates at an outlet 140 which has an internal diameter which is less than the internal diameter of the inlet 116 of the adapter 102. By sizing the outlet 140 such that it is narrower than the inlet 116 of the adapter 102, this eliminates the possibility of powder buildup between the funnel 104 and the adapter. Below the outlet 140, the funnel 104 includes a threaded coupling 142 having internal threads 144 which are complimentary to the external threads 107 located on the adapter 102. The internal threads 144 generally have an internal diameter greater than the diameter of the outlet 140. Externally, the threaded coupling 142 may be textured similar to the textured portion 110 of the adapter 102 to provide extra grip for a user when engaging or disengaging the threaded coupling between the adapter 102 and the funnel 104.

Turning now to FIGS. 5 and 6, the reloading assembly 100 is shown assembled, with the adapter 102 and the funnel 104 threadingly engaged. In the constructed state, the inlet 116 of the adapter 102 and the outlet 140 of the funnel 104 are not only adjacent but preferably are abutting, thereby minimizing the risk of any powder being undesirably trapped between the adapter 102 and the funnel 104. FIG. 6 shows a close-up view of the threaded coupling 142, illustrating that the inner diameter of the funnel outlet 140 is less than the maximum inner diameter of the adapter inlet 116, and that the inlet 116 of adapter 102 abuts the outlet 140 of funnel 104 when the reloading assembly 100 is assembled.

Referring to FIGS. 7 and 8, the reloading assembly 100 is shown with a plurality of additional adapters 202-602, with each adapter being sized to fit a different caliber round. In the embodiment shown, adapter 202 is for .24 caliber rounds, adapter 302 is for .25 or .26 caliber rounds, adapter 402 is for .28 caliber rounds, adapter 502 is for .30 caliber rounds, and adapter 602 is for .338 caliber rounds. Each of the adapters includes a threaded top portion 106, 206, 306, 406, 506, 606, each of which is identical to the others and is configured to threadingly couple with the funnel 104. For each adapter 102-602, the maximum outer diameter is substantially equal to the outer diameter of the threaded coupler 142 of the funnel 104. The adapters 102-602 have substantially equal outer diameters to each other, but while some of the adapters (such as adapters 302-602) may have substantially equal lengths to each other, generally the adapters may have different lengths (such as adapters 102 and 202 being comparatively longer than adapters 302-602) from one another in order to maintain the critical geometrical relationships present in the internal passage of each adapter 102-602. This is best shown in FIG. 8, which illustrates a cross-section view of each adapter 102-602, as well as the funnel 104 and an example casing 10. For each adapter 102-602, the respective internal passage includes a first tapered section and a second tapered section connected by a radiused transition portion. For each adapter 102-602, the draft angle of the first tapered section may vary, however the draft angle of the second tapered section is less than or equal to four degrees. This ensures that for each adapter 102-602, and therefore each size of casing, the possibility of powder bridging is minimized, and flow rate of powder through the passage is maximized. One of skill in the art will understand that the possible adapter sizes include those sized for all standard casing sizes either now known or later developed, and is not limited solely to the sizes shown in FIGS. 7 and 8.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed is:

1. An apparatus for dispensing powdered material, the apparatus comprising:

a funnel having an inlet, an outlet, and a threaded coupling disposed below the outlet; and an annular adapter having a complimentary threaded coupling configured to selectively engage with the threaded coupling disposed on the funnel, the adapter having an internal passage therethrough, the passage comprising:

an inlet;

a first tapered section extending downwardly from the inlet, the first tapered section having a first draft angle; and a second tapered section extending downwardly from the first tapered section, the second tapered section having a second draft angle;

wherein the inlet of the internal passage has a diameter greater than a diameter of the outlet of the funnel; and wherein the first draft angle is greater than the second draft angle.

2. The apparatus according to claim 1, wherein the internal passage further comprises a radiused transition portion disposed between the first tapered section and the second tapered section.

3. The apparatus according to claim 1, wherein the first draft angle is less than or equal to 35 degrees.

4. The apparatus according to claim 1, wherein the second draft angle is less than or equal to four degrees.

5. The apparatus according to claim 1, wherein the internal passage further comprises a casing seat configured to partially enclose a shell casing.

6. The apparatus according to claim 5, wherein the internal passage has a minimum internal diameter less than a minimum internal diameter of a shell casing sized to fit within the casing seat.

7. The apparatus according to claim 1, wherein the inlet of the internal passage of the adapter abuts the outlet of the funnel when the adapter and the funnel are threadingly coupled.

8. The apparatus according to claim 1, wherein the threaded coupling disposed on the funnel has an outer diameter substantially equal to a maximum outer diameter of the adapter.

9. An apparatus for reloading gunpowder into a casing, the apparatus comprising:

a funnel having an inlet, an outlet, and a threaded coupling disposed below the outlet; and a threaded adapter, the adapter comprising:

a top portion having a complimentary threaded coupling configured to selectively engage with the threaded coupling disposed on the funnel;

a main body having an internal passage therethrough, the passage comprising:

an inlet;

a first tapered section extending downwardly from the inlet, the first tapered section having a first draft angle;

a second tapered section extending downwardly from the first tapered section, the second tapered section having a second draft angle;

a radiused transition portion disposed between the first tapered section and the second tapered section; and a cavity configured to partially enclose a shell casing;

wherein the inlet of the internal passage has a diameter greater than a diameter of the outlet of the funnel; and wherein the first draft angle is greater than the second draft angle.

10. The apparatus according to claim 9, wherein the first draft angle is less than or equal to 35 degrees.

11. The apparatus according to claim 9, wherein the second draft angle is less than or equal to four degrees.

12. The apparatus according to claim 9, wherein the inlet of the internal passage of the adapter abuts the outlet of the funnel when the adapter and the funnel are threadingly coupled.

13. The apparatus according to claim 9, wherein the cavity includes a substantially horizontal shelf configured to abut an upper surface of the shell casing, the shelf being adjacent to the second tapered section of the passage.

14. The apparatus according to claim 13, wherein the shelf has a width greater than or equal to a wall thickness of the shell casing.

15. The apparatus according to claim 9, wherein the adapter further comprises a visual indicium disposed on an exterior surface of the main body, the visual indicium being related to a size of the shell casing configured to fit within the cavity.

16. A method of reloading a shell casing with powder, the method comprising:

providing a hollow shell casing configured to receive powder;

providing a funnel having an inlet, an outlet, and a threaded coupling;

providing at least one interchangeable adapter having a complimentary threaded coupling, an internal passage having an inlet, a first tapered section extending downwardly from the inlet, a second tapered section joined to the first tapered section by a radiused transition portion, and a casing seat for holding a shell casing;

coupling one of the at least one interchangeable adapter to the funnel via the threaded coupling, such that the funnel outlet abuts the inlet of the internal passage of the coupled adapter;

inserting the shell casing into the casing seat such that the casing abuts an upper surface of the shell casing; and adding powder into the funnel inlet such that the powder flows through the coupled adapter into the shell casing.

17. The method according to claim 16, wherein the at least one interchangeable adapter is a plurality of interchangeable adapters, each adapter being sized to receive a different sized shell casing and comprising:

a threaded coupling configured to selectively engage with the threaded coupling disposed on the funnel;

a first tapered section extending downwardly from the inlet, the first tapered section having a first draft angle;

a second tapered section extending downwardly from the first tapered section, the second tapered section having a second draft angle less than the first draft angle;

a radiused transition portion disposed between the first tapered section and the second tapered section; and a casing seat for holding a shell casing.

18. The method according to claim 16, further comprising:

providing a loading block; and securing the shell casing in the loading block before adding the powder to the funnel.

19. A method of instructing a user to load a shell casing with powder, the method comprising:

providing the user with a funnel having an inlet, an outlet, and a threaded coupling;

providing the user with at least one interchangeable adapter having a complimentary threaded coupling, an internal passage having an inlet, a first tapered section extending downwardly from the inlet, a second tapered section joined to the first tapered section by a radiused transition portion, and a casing seat for holding a shell casing;

instructing the user to couple one of the at least one interchangeable adapter to the funnel via the threaded coupling, such that the funnel outlet abuts the inlet of the internal passage of the coupled adapter;

instructing the user to insert a shell casing into the casing seat such that the casing seat abuts an upper surface of the shell casing; and instructing the user to insert powder into the funnel inlet such that the powder flows through the coupled adapter into the shell casing.

20. The method according to claim 19, wherein the at least one interchangeable adapter is a plurality of interchangeable adapters, each adapter being sized to receive a different sized shell casing and comprising:

a threaded coupling configured to selectively engage with the threaded coupling disposed on the funnel;

a first tapered section extending downwardly from the inlet, the first tapered section having a first draft angle;

a second tapered section extending downwardly from the first tapered section, the second tapered section having a second draft angle less than or equal to 4 degrees;

a radiused transition portion disposed between the first tapered section and the second tapered section; and a casing seat for holding a shell casing.

* * * * *